US005711619A

United States Patent [19]

Kaneko et al.

[11] Patent Number: 5,711,619

[45] Date of Patent: Jan. 27, 1998

[54] PRINTING APPARATUS

[75] Inventors: Yuichi Kaneko; Jun-ichi Arakawa, both of Yokohama, Japan

[73] Assignee: Canon Kabushiki Kaisha, Tokyo, Japan

[21] Appl. No.: 508,258

[22] Filed: Jul. 27, 1995

[30] Foreign Application Priority Data

Jul. 29, 1994 [JP] Japan ..... 6-178125

[51] Int. Cl.[6] ..... B41J 2/12

[52] U.S. Cl. ..... 400/74; 400/175; 347/19

[58] Field of Search ..... 400/74, 175, 703; 347/19, 50

[56] References Cited

U.S. PATENT DOCUMENTS

| | | | |
|---|---|---|---|
| 4,872,027 | 10/1989 | Buskirk et al. | 400/175 |
| 5,235,351 | 8/1993 | Koizumi | 400/175 |
| 5,398,053 | 3/1995 | Hirosawa et al. | 347/19 |

FOREIGN PATENT DOCUMENTS

| | | |
|---|---|---|
| 0274435 | 7/1988 | European Pat. Off. . |
| 0374762 | 6/1990 | European Pat. Off. . |
| 0380199 | 8/1990 | European Pat. Off. . |
| 0556011 | 8/1993 | European Pat. Off. . |
| 1-34746 | 2/1989 | Japan . |

*Primary Examiner*—John S. Hilten

*Attorney, Agent, or Firm*—Fitzpatrick, Cella, Harper & Scinto

[57] ABSTRACT

In a printing apparatus of the type in which a printing head is detachable to a carriage, a detecting circuit is provided for detecting whether or not a printing head 8 is mounted on a carriage. A CPU 2 included in the printing apparatus supervises the output of the detecting circuit at every predetermined time interval. When determined the printing head 8 is not mounted, the supplement of the driving voltage for the printing head 8 is suspended.

12 Claims, 4 Drawing Sheets

PRINTING APPARATUS

BACKGROUND OF THE INVENTION

1. Field of the Invention

The present invention relates to a printing apparatus in which a printing head is detachable from the main body of the printing apparatus.

2. Brief Description of the Prior Art

In a conventional printing apparatus of the type having a printing head which is adapted to be detachable, a voltage is applied to the electric contact portion of the carriage to which a printing head is equipped, regardless of whether the printing head is fitted or not.

However, in the conventional construction as mentioned above, since a voltage is applied on the electric contact portion of the carrier even the printing head is not yet equipped, there was a problem of safety, such as possibility of short-circuit caused by incident contact of a metallic object.

SUMMARY OF THE INVENTION

In view of the afore-mentioned disadvantages, an object of the present invention is to provide an improved printing apparatus over such disadvantages.

Another object of the present invention is to provide a printing apparatus of improved reliability, in which a printing head is detachable to the main body.

A further object of the present invention is to provide a printing apparatus in which the supplement of electric power is prevented when the printing head is not installed.

These and the other objects of the present invention will be more apparent from the accompanying drawings and the following detailed description.

DETAILED DESCRIPTION OF THE PREFERRED EMBODIMENTS

Figure 1:
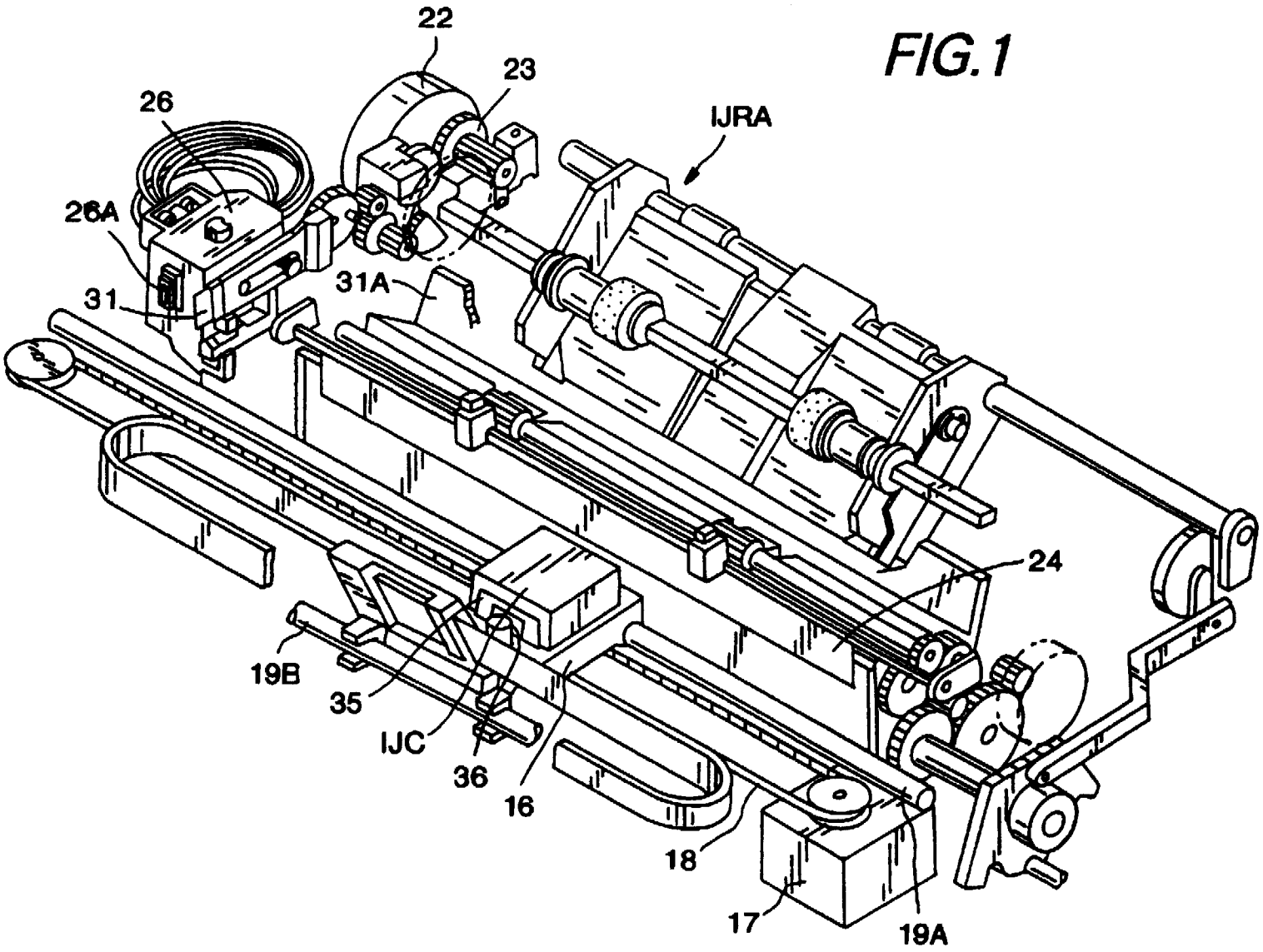
FIG.1 is a perspective view illustrating the construction of a printing apparatus according to the present invention.
Figure 2:
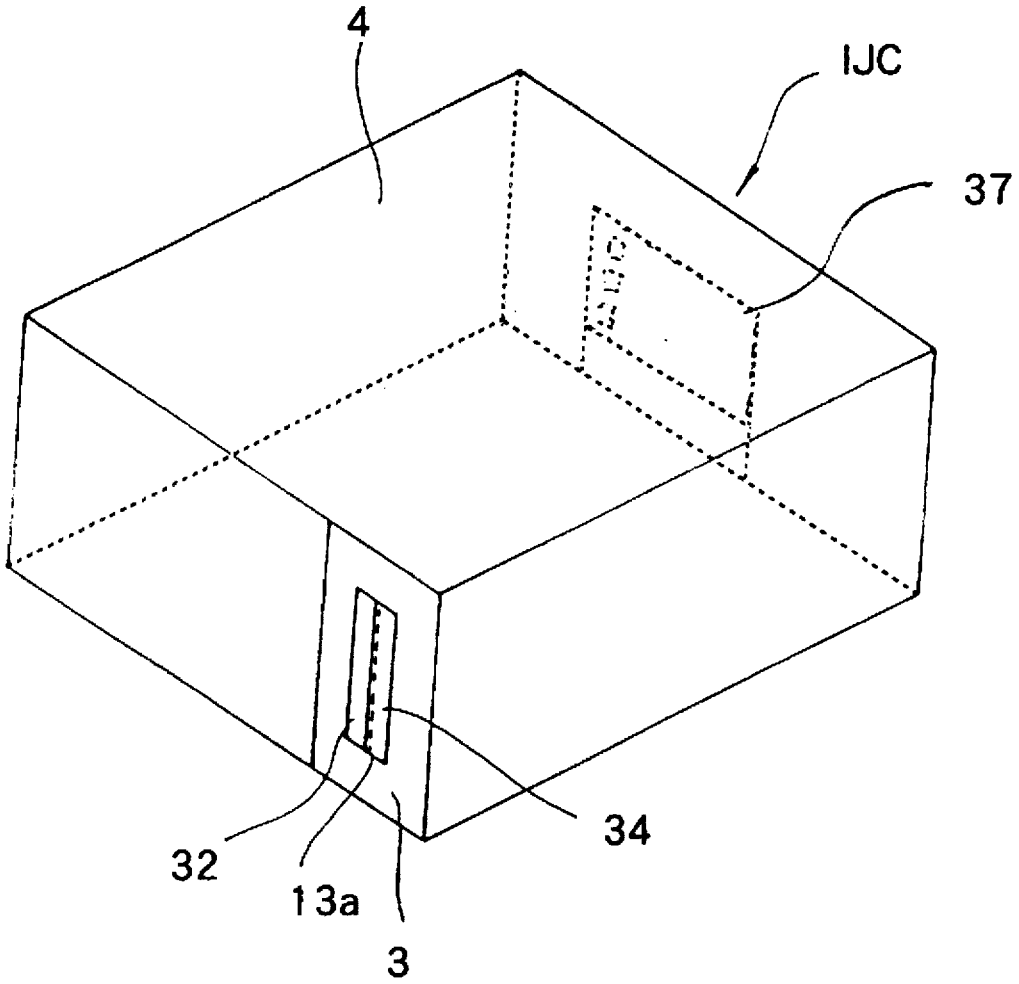
FIG.2 is a perspective view of an ink cartridge.

Referring to the drawings, the embodiment of the present invention is described. FIGS. 1 and 2 show an embodiment of the invention.

In FIG.1, the symbol IJC denotes an ink jet cartridge of a disposal type which is detachable to a carriage 16 in an appropriate manner. One or more of such cartridges may be installed depending on the ink in use for printing. Each of the ink jet cartridges may be provided with a recording head 3 of the bubble jet type which ejects ink by state conversion caused by using thermal energy, and with an ink tank 4. The recording head B is supplied with ejection signals in accordance with the recording data from a data source through a cable and terminals connected thereto. The front end of recording head 3 is slightly projecting from the front face of the ink tank 4. Onto the heater board 32, a guard plate 34 having a partition for defining a fluid passage is secured. The guard plate 34 is formed of an ink resistant material, such as resins including polysulfone, polyethersulfone, polyphenyleneoxide, or polypropylene. The ink tank 4 for storing the ink to be supplied to recording head 3 is composed of an ink absorbing member, a container for accommodating ink, and a sealing member for the ink (all are not shown in FIG.2). The ink stored in the ink tank 4 is discharged through the ink discharge outlet and successively supplied to the recording head B.

The carriage 16 is connected to a part of a driving belt 18, and is slidably supported by a pair of guide shafts 19A and 19B for reciprocal movement along the guide shafts 19A and 19B over the entire width of the recording medium. The relative movement of the carriage 16 and the recording medium is controlled by application of a predetermined recording signal to form a desired recording image.

A head recovery device 26 is mounted at one end of the moving track of the recording head 3, for example, at a position opposite to of the home position. By way of the driving force generated by a motor 22 through a transmission device 23, the head recovery device 26 is operated to perform capping onto recording head 3. In conjunction with the capping operation by means of the capping port 26A of the head recovery device 26, the treatment of ink ejection recovery is performed, such as removing the ink which has an increased viscosity by compulsory discharging the ink from the ink discharge outlet, by means of suitable absorbing means provided within the head recovery device 26. Also, by providing capping at the termination of printing, the recording head 3 is protected.

The numeral 31 denotes a blade as a wiping member formed of silicone rubber, which is disposed on the side of the head recovery device 26. The blade 31 is supported by a blade support member 31A in the state of a cantilever, and is operated also by the motor 22 and the transmission device 23 like as the head recovery device 26, and is also enabled to engage with the discharge port of the recording head 3. By this arrangement, in the appropriate timing relationship with the recording operation of the recording head 3, or following the discharge recovery operation by the head recovery device 26, dew, wet or dust produced at the discharge port of the recording head 3 is wiped off in conjunction with the movement of the recording head 3.

A numeral 35 denotes a guide member provided on the carriage 16 for defining a reference plane for attaching the ink jet cartridge IJC. The guide member 35 is provided with terminals for supplying an electric power and a contact port 36 having terminals for applying an actuating signal (eject signal). The contact port 36 is connected to the contact port 37 provided on the ink jet cartridge IJC, upon coupling of the ink jet cartridge with the carriage 16, thereby supplement of electric power and of actuating signals for the recording head from the printing apparatus main body being enabled.

Figure 3:
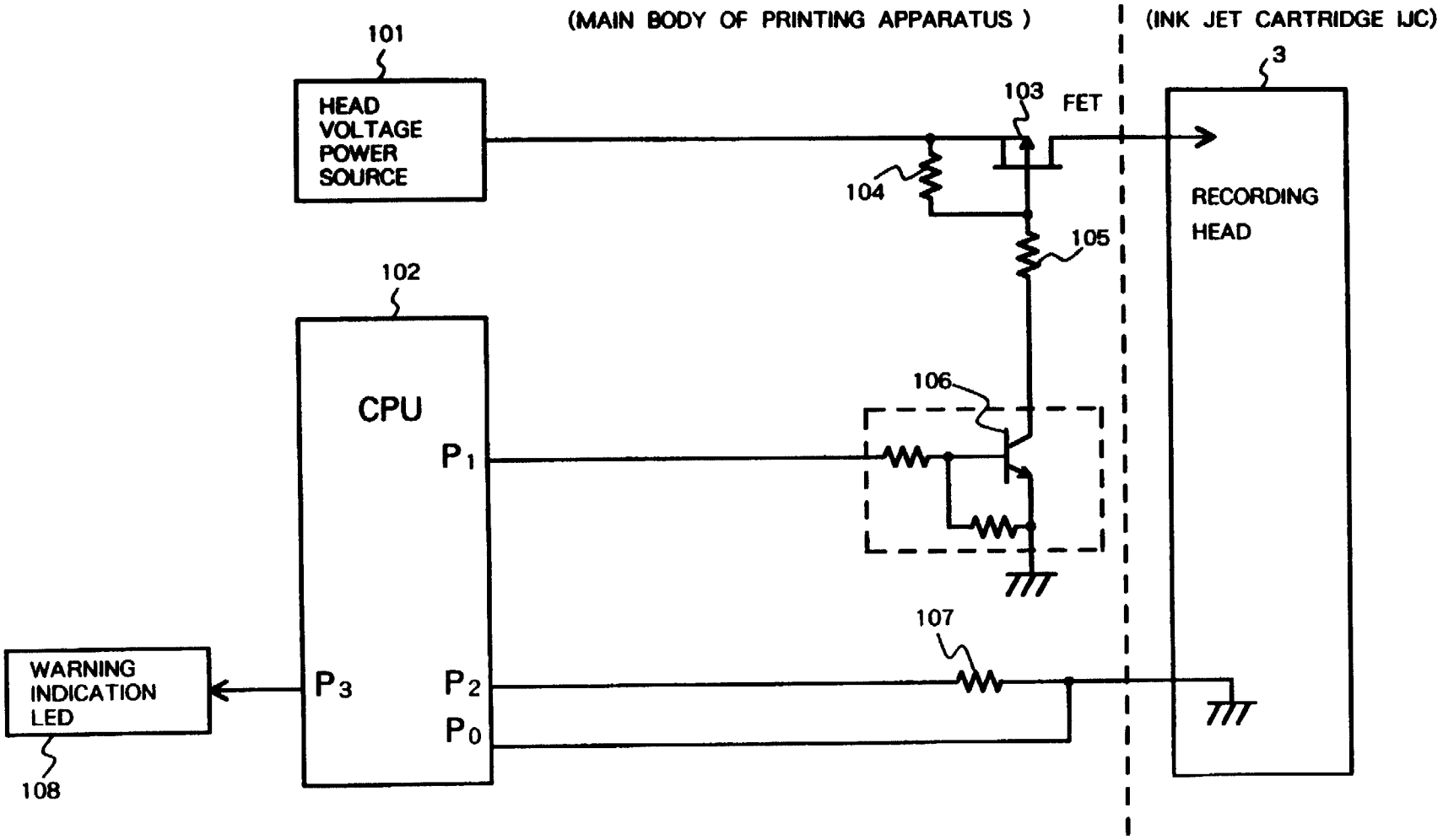
FIG.3 is a block diagram of a control device.

FIG.3 is a block diagram illustrating a control assembly of the printing apparatus represented in FIG.1. In FIG.3, there are shown a power source 101 for generating a head voltage to operate the recording head 3; a CPU 102 for controlling the entire printing apparatus; a FET 103 performing switching operation for turning on/off of head voltage supplied for the recording head 3; bias resistors 104 and 105; a transistor 106 for turning on/off of a switching FET 103; a resistor 107 for detecting whether the recording head 3 is attached or not; and a LED 108 for informing no attachment of the recording head 3.

Although not shown, a motor 17 for reciprocally moving the carriage 16, a motor 22 for actuating the recovery device 26, and a still another motor for feeding the recording medium and so on are also coupled to the CPU 102. Thus, the CPU 102 performs control operation in accordance with the program stored in a ROM which is not shown.

It is described the operation of the circuit above as follows. The CPU 102 sets the output port P2 at high level "H". At this time, if the level of the input port P0 is "H", it is determined "recording head 3 is not attached", and the output port P1 is set "L" to turn "off" the switching FET3, and turn "off" the voltage which is applied to the recording head 3 from the contact port 36. Also, the output port P3 is turned "H" to light up the LED 108.

On the other hand, if the input port PO is leveled at "L", it is determined "the recording head 3 is attached", and the output port P1 is set "H" to turn "on" the switching FET3, and the voltage is applied to the recording head 3.

Figure 4:
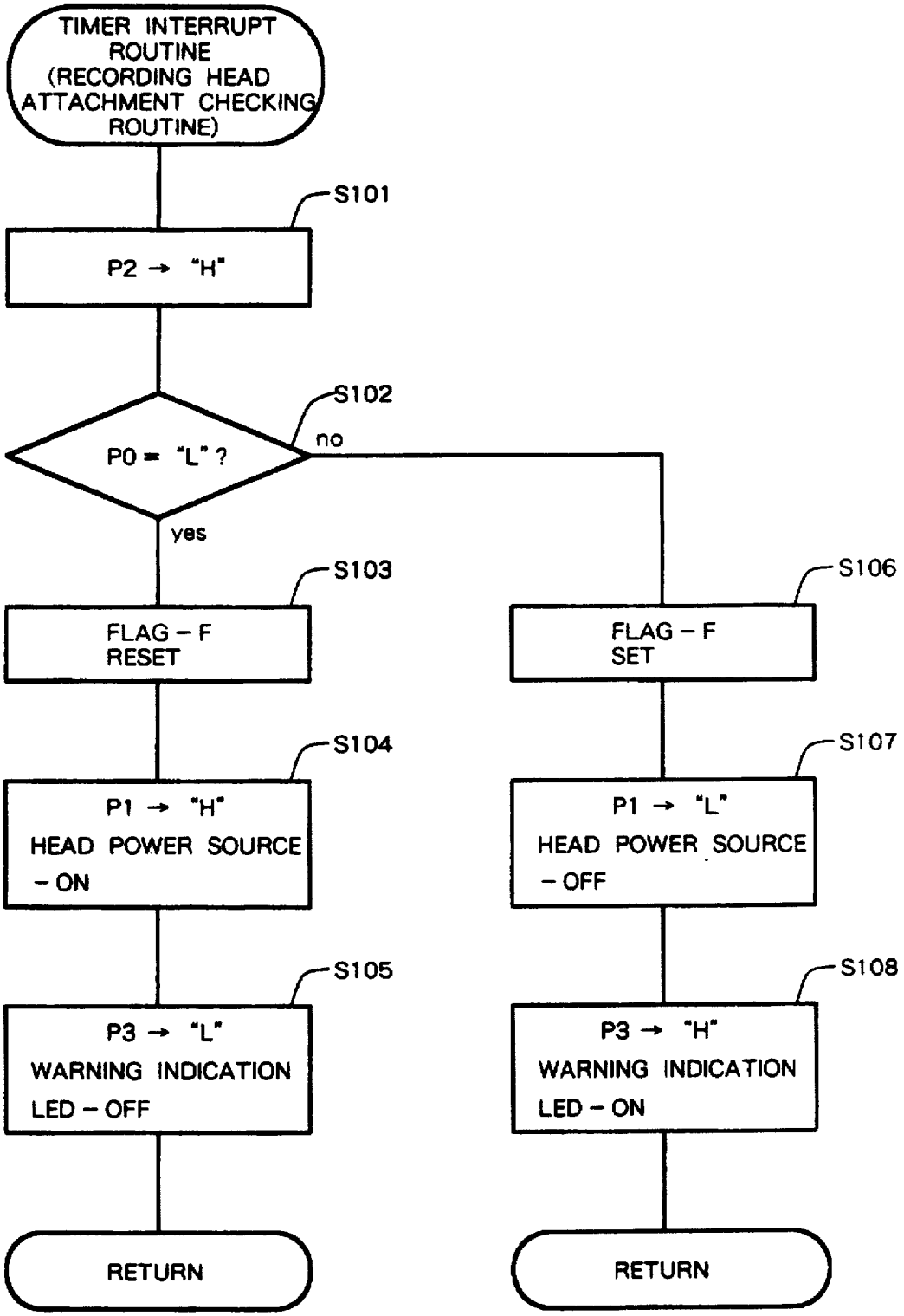
FIG.4 is a flow chart for checking the state of attachment of the printing head.

FIG.4 is a flow chart for executing the control operation mentioned above. A program corresponding to the flow chart is stored in the internal ROM within the illustrated CPU.

FIG.4 also shows a routine which is, by determining whether the recording head is attached to the carriage 16 to change-over the FET on/off, to cause the power supply for the head to turn on/off, as well as to cause the LED to turn on/off, and is constructed so as to perform routine operation to cause an interrupt at every predetermined time interval using an internal timer included in the CPU, thereby supervising the attachment of the recording head at every predetermined time interval.

First, the signal level of the output port P2 is turned to "H" at the Step S101. Then, the level of the signal applied to the input port PO is determined as to whether "L" or not.

Since, when the recording head is installed, the signal is turned to the level "L", and moved to Step 103, a FLAG F provided in a predetermined region of a not shown RAM for storing the state of attachment of the recording head is reset; at Step 104, the power supply is turned "on", and, at Step 105, the warning indication LED 108 is turned "off".

On the other hand, in the case of no attachment of the recording head, the level of input signal is turned to "H", accordingly, proceeding to Step 106, the power source is turned "off" at Step 107 , and the warning indication LED 108 is turned "on" at Step 108.

Also, in the case of no attachment of the recording head, that is the FLAG F is set, the CPU 102 does not execute the recording operation, even though the recording instruction is produced.

As discussed above, the presence of the recording head is detected for turning on/off of voltage application to the recording head, and, therefore, when the recording head and the contact port are bared due to the absence of the recording head, the voltage application to the contact port does not occur and the problem of short-circuit by the foreign object such as metal plate can be prevented.

The present invention has been discussed on an example of a bubble jet type printer, but is not limited thereto, and is also applicable for any type of printers, including those utilizing the heads of piezo type, of thermal head, or wire dot hammer types.

What is claimed is:

1. A printing apparatus using a printing head to record an image onto a recording medium in accordance with recording data, said printing head being detachable relative to said printing apparatus and supplied with electric energy from said printing apparatus to operate, and further said printing head forming a status signal indicating its mounting condition in accordance with a predetermined signal from said printing apparatus, said printing apparatus comprising:

mounting means for mounting said printing head;

power supply means for supplying electric power to said printing head;

generating means for generating said predetermined signal at every predetermined time interval;

detecting means for detecting at every predetermined time interval whether said printing head is mounted on said mounting means in accordance with said status signal formed by said printing head in response to said predetermined signal generated by said generating means; and control means responsive to the result of said detection by said detecting means for stopping the supply of electric power to said printing head from said power supply means.

2. A printing apparatus according to claim 1, wherein said power supply means is provided with an electric contact port connected to another electric contact port associated with said recording head, upon mounting said recording head onto said mounting means.

3. A printing apparatus according to claim 1, further comprising scanning means for record scanning by causing movement of said recording head relative to said recording medium, said mounting means is provided on said scanning means.

4. A printing apparatus according to claim 1, wherein said printing head includes an ink jet head assembly for ejecting ink droplets in accordance with said recording data.

5. A printing apparatus according to claim 4, wherein said printing head further includes an ink storing section for storing ink to be supplied to said ink jet head assembly.

6. A printing apparatus according to claim 5, wherein said ink jet head assembly and said ink storing section are formed integrally with each other.

7. A printing apparatus according to claim 4, wherein said ink jet head assembly ejects the ink droplets from an ink discharge outlet by causing a state conversion of the ink by use of thermal energy.

8. A control device for a printing apparatus having a printing head to record an image onto a recording medium in accordance with recording data, said printing head being detachable relative to a main body of said printing apparatus and supplied with electric energy from said printing apparatus to operate, and further said printing head forming a status signal indicating its mounting condition in accordance with a predetermined signal from said printing apparatus, said control device comprising:

generating means for generating said predetermined signal at every predetermined time interval;

detecting means for detecting at every predetermined time interval whether said printing head is mounted on said mounting means in accordance with said status signal formed by said printing head in response to said predetermined signal generated by said generating means; and control means responsive to the result of said detection by said detecting means for stopping the supply of electric power to said printing head from said power supply means.

9. A control device according to claim 8, wherein said printing head includes an ink jet head assembly for ejecting ink droplets in accordance with said recording data.

10. A control device according to claim 9, wherein said printing head further includes an ink storing section for storing ink to be supplied to said ink jet head assembly.

11. A control device according to claim 10, wherein said ink jet head assembly and said ink storing section are formed integrally with each other.

12. A control device according to claim 9, wherein said ink jet head assembly ejects the ink droplets from an ink discharge outlet by causing a state conversion of the ink by use of thermal energy.

* * * * *

UNITED STATES PATENT AND TRADEMARK OFFICE

CERTIFICATE OF CORRECTION

PATENT NO. : 5,711,619

DATED : January 27, 1998

INVENTOR(S) : YUICHI KANEKO, ET AL.

It is certified that error appears in the above-identified patent and that said Letters Patent is hereby corrected as shown below:

COLUMN 1

Line 59, "head B" should read --head 3--.

COLUMN 2

Line 5, "head B" should read --head 3--.

COLUMN 3

Line 26, "not." should read --not in Step S102.--;
Line 28, "Step 103," should read --Step S103,--;
Line 31, "Step 104," should read --Step S104,--;
Line 32, "105," should read --S105,--;
Line 35, "Step 106," should read --Step S106,--;
Line 36, "Step 107," should read --Step S107,--; and
Line 37, "Step 108." should read --Step S108.--.

Signed and Sealed this

Eleventh Day of August 1998

Bruce Lehman

*Attest:*

BRUCE LEHMAN

*Attesting Officer*

*Commissioner of Patents and Trademarks*